United States Patent [19]

Stanton et al.

[11] Patent Number: 4,742,784

[45] Date of Patent: May 10, 1988

[54] METHODS FOR REDUCING NITROGEN OXIDES EMISSIONS FROM POWER PLANTS FIRED BY VARIOUS COALS

[76] Inventors: Austin N. Stanton; Leonard J. Keller, both of 1501 N. Cedar St., Bonham, Tex. 75418

[21] Appl. No.: 99,973

[22] Filed: Sep. 23, 1987

[51] Int. Cl.[4] ..... F23D 1/00

[52] U.S. Cl. ..... 110/347; 44/620; 110/224; 110/342

[58] Field of Search ..... 110/342, 224, 229, 230, 110/347; 44/1 R, 1 F, 1 G

[56] References Cited

U.S. PATENT DOCUMENTS

| | | | |
|---|---|---|---|
| 4,381,718 | 5/1983 | Carver et al. | 110/347 |
| 4,528,918 | 7/1985 | Sato et al. | 110/347 |
| 4,676,804 | 6/1987 | Miller et al. | 44/1 R |
| 4,702,747 | 10/1987 | Meyer et al. | 44/1 R X |

*Primary Examiner*—Edward G. Favors

[57] ABSTRACT

Fluctuating prices and conservation of oil demand substitution of coal therefor, but coal as currently used, produces unacceptable amounts of nitrogen oxides. The problem arises from the inherently poor combustion characteristics of such pulverized solid fuels, the long combustion time intervals required, and the great amounts of excess combustion air required to complete combustion. The methods of the present invention minimize the formation of nitrogen oxides by modifying or adding several steps in the combustion process. Heating the coal to evacuate the pores and capillary openings in the coal structure prepares it for suffusion and storage in an inert atmosphere of carbon dioxide to prevent partial oxidation of coal constituents and adsorption or permeation of nitrogen from the air. Many advantages are gained by replacing carbon dioxide in the pores and capillary openings with methanol. These resultant highly reactive fuels permit reduction of excess air without producing undesirable amounts of carbon monoxide. Shortened combustion time allows reduction of the volume of the firebox to minimize retention time at high temperature and to improve boiler efficiency. Further improvements obtain from recirculating some combusted gases to the firebox or adjusting the volume of the firebox, to control retention time at lower firing rates and to minimize slagging.

5 Claims, No Drawings

METHODS FOR REDUCING NITROGEN OXIDES EMISSIONS FROM POWER PLANTS FIRED BY VARIOUS COALS

BACKGROUND OF THE INVENTION

Much concern is being expressed regarding the high nitrogen oxides levels of exhaust gases from lignite-fired and coal-fired electric power plants and industrial boilers, particularly those having very large fireboxes to accommodate high moisture-content coals and lignites, which are inherently low in fuel value. The typical fuels of concern are the lignites of North Dakota and Texas and the low-sulphur coals of the Powder River Basin in Wyoming. The large fireboxes required to provide sufficient retention time for the relatively complete combustion of these types of coaliferous fuels causes the formation of very high levels of nitrogen oxides in the exhaust gases. These are some of the lowest sulphur-level coaliferous fuels in the nation, and for that reason are most desirable for use as boiler fuels, except for the high nitrogen oxides emissions produced.

The problem arises from the inherently poor combustion characteristics of many coals, the long combustion time intervals required, and the great amounts of excess combustion air required to complete combustion. New means effectively reduce the nitrogen oxides emissions from the types of boiler plants described hereinabove and from other boiler plants burning coals, lignites or anthracites which are difficult to burn.

New boiler plants can be specifically designed for the greatly improved fuels described hereinafter. Preparing the fuels at the mine site and shipping them in sealed containment by truck, rail, barge or ship can greatly reduce the cost per unit of heating value for shipping coals which otherwise would have to be shipped at high moisture levels.

SUMMARY OF THE INVENTION

In prior art processes, the products of combustion are retained in the firebox at maximum temperatures, in the presence of large quantities of excess air, and for long periods of time, to attain relatively complete combustion. These practices cause the generation of excessive amounts of nitrogen oxides. The present invention minimizes formation of nitrogen oxides by special treatment in several of the usual steps and addition of new steps in the combustion of pulverulent coals. Heating the coal to evacuate the pores and capillary openings in the coal structure prepares it for suffusion in an inert atmosphere of carbon dioxide to prevent degredation of heating quality. Many advantages are gained by replacing carbon dioxide in the pores and capillary openings with methanol to improve fuel reactivity. These highly reactive fuels permit reduction of excess air, without production of excessive amounts of carbon monoxide. Shortened combustion time allows reduction of the volume of the firebox to shorten retention time therein and to improve boiler efficiency. Further improvements obtain from recirculating some exhaust gases to the firebox to control retention time and to minimize slagging. Retention time at reduced firing rates (turndown) are controlled by adjusting the volume of the firebox to match the combustion gas volumetric flow rate. These steps significantly minimize formation of nitrogen oxides while maintaining high boiler efficiency.

DETAILED DESCRIPTION

Fluctuating prices and conservation of oil demand substitution of coal therefor, but coal, as currently used for boiler fuels, produces unacceptable amounts of nitrogen oxides. The problems arise from the inherently poor combustion characteristics of pulverized solid fuels, or coals, the long combustion time intervals required, and the great amounts of excess combustion air required to complete combustion. In prior art processes, the products of combustion are retained in the firebox at maximum temperatures, in the presence of large quantities of excess air, and for long periods of time, to attain relatively complete combustion, to prevent smoking, and to minimize carbon monoxide in the exhaust gases. These practices cause the generation of excessive amounts of nitrogen oxides. Much concern is being expressed regarding the high nitrogen oxides levels of exhaust gases from lignite-fired and coal-fired electric power plants and industrial boilers, particularly those having very large fireboxes to accommodate high moisture-content coals and lignites, which are inherently low in fuel value. The typical fuels of concern are the lignites of North Dakota and Texas and the low-sulphur coals of the Powder River Basin in Wyoming. These are some of the lowest sulphur-level coaliferous fuels in the nation, and for that reason are most desirable for use as boiler fuels, except for the high nitrogen oxides emissions produced.

Special treatment in currently used steps of the combustion process and unique new steps define the methods herein claimed for effectively reducing the nitrogen oxides emissions from the types of boiler plants described hereinabove and from other boiler plants burning coal of any the various classifications.

The new methods require, as a first step, drying of the coals, lignites or anthracites, hereinafter referred to as "coal" or "coals", to very low moisture levels, or to virtually zero moisture levels, or even to a condition of partial or incipient pyrolysis. The temperatures and retention time in drying are controlled to effect the removal of all surface, or free, moisture and to remove liquid phase water and other readily volatilized materials from the internal pores and capillary openings within the coals, thereby leaving the structures porous and permeable. This increases the heating value of the fuel on a Btu per pound basis and also improves the combustion characteristics. It also greatly increases the reactivity of the fuel in the oxidation process. This reduces the time required for essentially complete combustion of the fuel-air mixture. The improved reactivity also allows operation at lower levels of excess air in the fuel-air mixture, while still gaining very good fuel conversion efficiencies and low carbon monoxide levels in the exhaust gases. The combined improvements make possible the reduction of the size of the firebox in which the fuel is burned to the optimum volumetric size and configuration to minimize the retention time of the gaseous products of the combustion reactions, and of the fly ash materials released from the coal. The rapid oxidation of the reactive fuel, the short retention time in the high temperature zone of the firebox, the low excess of combustion air, and the rapid reduction of the temperature of the products of combustion achieved by reducing the volume of the firebox, all contribute to lowering the amounts of nitrogen oxides formation. The somewhat higher temperatures of combustion are more than offset by the shorter retention times and the lesser amounts of excess air required for complete combustion.

The second step takes advantage of the fact that this process for drying of the coal removes the liquid water and other vaporizable materials from the pores and capillary openings in the coal and replaces these with carbon dioxide and water vapor. When methanol (methyl alcohol) comes in contact with such materials, the internal pores and capillary openings are penetrated and filled with multi-molecular layers of attached methanol molecules. These molecules are sufficiently small to fit into the tiniest of the openings, which are only about twenty Angstroms in width. Few other molecules are sufficiently small to do so. The methanol molecules have a strong affinity for the coaliferous surfaces, and the coating and filling is apparently quite complete. The bonding is polar in nature to the extent that the increase in density of saturated coal is greater than would be expected by simply filling the available openings with methanol liquid. The methanol itself is also a most excellent fuel.

When these treated coal particles, called pulverulent carbonaceous fuels, are burned as fuel in boilers, they literally explode when heated by the ultra-violet radiation produced by the photon energy emission accompanying the chemical reaction of combustion oxidation. This enhances the rapid sublimation of coal to carbon atoms and the subsequent rapid oxidation to carbon dioxide, id est, burning of the coal. These steps improve the combustion of coals of any classsification, and effect substantial reduction of nitrogen oxide formation from these difficult-to-burn fuels. The methanol activation can even be used with any of the coals or lignites discussed hereinabove to further improve the combustion characteristics and effect even greater reductions in retention time required, volume of firebox required, amount of excess air required, and amount of nitrogen oxides produced. These technologies can also be applied to many coals with relatively low initial moisture content, such as the anthricites, which simply have poor oxidation reactivity, and therefore do not burn well.

The improvements described herein provide means for gaining very significant reductions in nitrogen oxides emissions from electric power plants burning coals, lignites, or anthracites, and from industrial boilers as well. The conversion costs and operating costs should be minimal compared to other control technologies proposed, and the time required for conversion of plants should be minimal. The generation of nitrogen oxides at reduced firing rates may be minimized by recirculating some of the exhaust gases back to the combustion area of the firebox to offset the consequent increases in retention time caused by the lower volumes of gases generated.

Slagging problems with low ash-fusion-temperature coals can be contrilled by recirculating combustion gases to the firebox, past the point of complete combustion, but before the first heat exchange tubing. This can reduce the temperature of the gases sufficiently to prevent slagging damage to the boiler tubing.

The adverse increases in retention time in the firebox at lower than maximum firing rates (turndown), are controlled by adjusting the volume and configuration of the firebox to match the volumetric flow rate of combustion gases, thereby maintaining near-optimum retention time for low nitrogen oxides formation at all firing rates.

No attempt has been made herein to address all of the subtleties of current combustion processes. Hence, although this invention has been described with a certain degree of particularity, it is understood that the present disclosure has been made only by way of example, and that numerous changes in the details of the methods and arrangement of steps therein may be resorted to without departing from the spirit and scope of this invention.

As our invention we claim:

1. In steam boilers burning various classes of coal as pulverized carbonaceous fuels, in which nitrogen oxides are produced in unacceptable concentrations in the exhaust gases therefrom as the result of the inherently poor combustion characteristics of the said pulverized carbonaceous fuels, the wide range of said characteristics, the long combustion time intervals required and the great amounts of excess combustion air required to complete combustion in current combustion programs; the improvement in methods of preparing said fuels and of effecting reduction in said nitrogen oxides in the exhaust gases, comprising:

evacuating the pores and capillary openings of the particular coal structure by heating inert combustion gases, either before or after pulverizing, sufficiently to remove all free water and to remove liquid water and other readily volatilized materials;

handling and storing the evacuated coal in an inert atmosphere of carbon dioxide to prevent partial oxidation of coal constituents and adsorption or permeation of nitrogen from the air, thereby providing highly reactive fuel, more readily combustible to essentially complete combustion in a very short period of time;

reducing to a minimum the amount of excess air required by said reactive fuels to achieve essentially complete combustion with minimal carbon monoxide generation; and reducing the volume of the firebox sufficiently to provide the optimum retention time for the reduced volume of gases generated during combustion, compared to the prior art methods, the boiler efficiency is improved because the lesser volume of gases provides longer retention time in the boiler for heat exchange and the amounts of nitrogen oxides and carbon monoxide in the exhaust gases are reduced.

2. The method as described in claim 1 wherein:

filling said pores and capillary openings with methanol further improves the combustion characteristics, further reduces said time required for complete combustion, allows further reduction in the amount of excess air, allows further reduction in the volume of the firebox, and therefore further effects reduction in said nitrogen oxides levels in the exhaust gases therefrom.

3. The method as described in claim 1 wherein:

some of said exhaust gases are recirculated to said firebox, past the zone of complete combustion, to minimize slagging and boiler tube damage, caused by the higher temperatures of said improved combustion.

4. The method as described in claim 1 wherein:

some of said exhaust gases are recirculated into said firebox to maintain near-optimum retention time for products of combustion and fly ash from the fuel during operation at lower than maximum firing rates.

5. The method as described in claim 1 wherein:

the volume of the firebox is made variable to allow control of retention time at various firing rates for further minimizing nitrogen oxides levels in the exhaust gases therefrom.

* * * * *